US010006114B2

(12) United States Patent
Nakahigashi et al.

(10) Patent No.: US 10,006,114 B2
(45) Date of Patent: Jun. 26, 2018

(54) TITANIUM ALLOY, METHOD OF MANUFACTURING HIGH-STRENGTH TITANIUM ALLOY, AND METHOD OF PROCESSING TITANIUM ALLOY

(71) Applicants: THE JAPAN RESEARCH INSTITUTE OF INDUSTRIAL SCIENCE, Fukuyama-shi, Hiroshima (JP); HONDA MOTOR CO., LTD., Tokyo (JP)

(72) Inventors: Jun Nakahigashi, Fukuyama (JP); Kyo Takahashi, Wako (JP)

(73) Assignees: HONDA MOTOR CO., LTD., Tokyo (JP); THE JAPAN RESEARCH INSTITUTE OF INDUSTRIAL SCIENCE, Hiroshima (JP)

( * ) Notice: Subject to any disclaimer, the term of this patent is extended or adjusted under 35 U.S.C. 154(b) by 396 days.

(21) Appl. No.: 14/284,631

(22) Filed: May 22, 2014

(65) Prior Publication Data

US 2014/0356221 A1 Dec. 4, 2014

(30) Foreign Application Priority Data

May 29, 2013 (JP) ..... 2013-112841

(51) Int. Cl.
*C22F 1/18* (2006.01)
*C22C 14/00* (2006.01)

(52) U.S. Cl.
CPC ..... *C22F 1/183* (2013.01); *C22C 14/00* (2013.01)

(58) Field of Classification Search
None
See application file for complete search history.

(56) References Cited

U.S. PATENT DOCUMENTS 5,226,982 A * 7/1993 Eylon ..... B23K 20/002 148/522
5,630,890 A * 5/1997 Smashey ..... C22F 1/02 148/527

(Continued)

FOREIGN PATENT DOCUMENTS

JP H05255826 A 10/1993
JP 6-256919 A 9/1994

(Continued)

OTHER PUBLICATIONS

Yoshimura, H. et al. "Ultra-fine equiaxed grain refinement and improvement of mechanical properties of alpha + beta type titanium alloys by hydrogenation, hot working, heat treatment, and dehydrogenation." 1994. Materials Transactions, JIM 35. p. 266-272.*

(Continued)

*Primary Examiner* — Colleen P Dunn
*Assistant Examiner* — Nicholas A Wang
(74) *Attorney, Agent, or Firm* — Birch, Stewart, Kolasch & Birch, LLP

(57) ABSTRACT

Titanium alloy that is formed by subjecting titanium alloy to a treatment containing a hydrogen storing step for making the titanium alloy store hydrogen therein, a solution-treatment step for heating the titanium alloy having the hydrogen stored therein in the hydrogen storage step to apply a solution treatment to the hydrogen-stored titanium alloy, a cooling step for cooling the heated hydrogen-stored titanium alloy to develop martensitic transformation in the hydrogen-stored titanium alloy, a hot rolling step for heating the martensitic-transformed titanium alloy to a temperature which is not more than a predetermined transformation point and hot-rolling the martensitic-transformed titanium, and a dehydrogenation step for dehydrogenating the hot-rolled (Continued)

titanium alloy, thereby bringing the titanium alloy with the superplastic property.

16 Claims, 14 Drawing Sheets

(56) References Cited

U.S. PATENT DOCUMENTS

| | | | |
|---|---|---|---|
| 2012/0168042 | A1 | 7/2012 | Lee et al. |
| 2013/0000799 | A1 | 1/2013 | Kosaka et al. |

FOREIGN PATENT DOCUMENTS

| | | | |
|---|---|---|---|
| JP | 7-90525 | A | 4/1995 |
| JP | 2006-052418 | A | 2/2006 |
| JP | 2011-068955 | A | 4/2011 |

OTHER PUBLICATIONS

Yoshimura, H. et al. "Ultra-fine grain refinement and superplasticity of titanium alloys obtained through protium treatment." 2002. International Journal of Hydrogen Energy. 27. p. 769-774 (Year: 2002).*

Office Action issued in corresponding Japanese Patent Application No. 2013-112841 dated Aug. 2, 2016 (with machine generated English translation).

Japanese Patent Office, "Notification of Reasons for Refusal," issued in connection with Japanese Patent Application No. 2013-112841, dated Feb. 7, 2017.

* cited by examiner

FIG.15A

TABLE 1

| TEMPERATURE | MICRONIZED PARTICLE TITANIUM ALLOY (1) | | | | ROUGH PARTICLE TITANIUM ALLOY (2) | | | |
|---|---|---|---|---|---|---|---|---|
| | STRAIN RATE | DEFORMING STRESS | EXTENSION | m VALUE | STRAIN RATE | DEFORMING STRESS | EXTENSION | m VALUE |
| 973K (700°C) | 0.001 | 17.9 | 4050 | 0.47 | 0.001 | 21.2 | 4425 | 0.60 |
| | 0.005 | 38.3 | 5950 | 0.52 | 0.005 | 55.4 | 5750 | 0.81 |
| | 0.01 | 55.1 | 7350 | 0.44 | 0.01 | 97.3 | 3475 | 0.41 |
| | 0.05 | 112.6 | 3500 | 0.42 | 0.05 | 188.6 | 1425 | 0.44 |
| | 0.1 | 151 | 2250 | — | 0.1 | 256.1 | 363 | — |
| 1023K (750°C) | 0.001 | 11.0 | 3800 | 0.43 | 0.001 | 17.2 | 3250 | 0.37 |
| | 0.005 | 21.9 | 6700 | 0.54 | 0.005 | 31.4 | 4150 | 0.49 |
| | 0.01 | 31.8 | 8450 | 0.57 | 0.01 | 44 | 4675 | 0.64 |
| | 0.05 | 79.6 | 7000 | 0.45 | 0.05 | 124.1 | 1150 | 0.49 |
| | 0.1 | 108.4 | 1925 | — | 0.1 | 174 | 550 | — |
| 1073K (800°C) | 0.001 | 7.0 | 3450 | 0.47 | 0.001 | 7.28 | 3425 | 0.49 |
| | 0.005 | 15.0 | 4975 | 0.55 | 0.005 | 16.0 | 4725 | 0.88 |
| | 0.01 | 21.9 | 5900 | 0.59 | 0.01 | 29.39 | 4400 | 0.72 |
| | 0.05 | 56.2 | 3400 | 0.58 | 0.05 | 93.75 | 1900 | 0.42 |
| | 0.1 | 84.2 | 2625 | — | 0.1 | 125.66 | 1222.5 | 0.30 |
| | 0.5 | — | — | — | 0.5 | 204.1 | 300 | — |

FIG.15B

TABLE 2

| TEMPERATURE | MICRONIZED PARTICLE TITANIUM ALLOY (1) | | ROUGH PARTICLE TITANIUM ALLOY (2) | |
|---|---|---|---|---|
| | DEFORMING STRESS | EXTENSION | DEFORMING STRESS | EXTENSION |
| 873K (600°C) | 208.2 | 1975 | 397 | 325 |
| 923K (650°C) | 89.1 | 4425 | 200 | 1275 |
| 973K (700°C) | 55.1 | 7350 | 97.3 | 3475 |
| 1023K (750°C) | 31.8 | 8450 | 44 | 4675 |
| 1073K (800°C) | 21.9 | 5900 | 29.39 | 4400 |
| 1123K (850°C) | 18.6 | 2850 | 18.2 | 3225 |

TITANIUM ALLOY, METHOD OF MANUFACTURING HIGH-STRENGTH TITANIUM ALLOY, AND METHOD OF PROCESSING TITANIUM ALLOY

INCORPORATION BY REFERENCE

The present application claims priority under 35 U.S.C. § 119 to Japanese Patent Application No. 2013-112841 filed on May 29, 2013. The content of the application is incorporated herein by reference in its entirety.

FIELD OF THE INVENTION

The present invention relates to titanium alloy, high-strength titanium alloy, high-strength titanium alloy manufacturing method and titanium alloy processing method.

BACKGROUND OF THE INVENTION

Titanium alloy has been used in various fields because it has a characteristic that the specific strength is high and the corrosion resistance is excellent. On the other hand, enhancement in workability has been required to titanium alloy because titanium alloy is hard to cut and also deformation processing (plastic forming) on titanium alloy is difficult. Therefore, there has been proposed a method of obtaining titanium alloy having higher strength by containing hydrogen in titanium alloy (see JP-A-H07-90525 (hereinafter referred to as "publication 1"), for example). According to this publication 1, near α type titanium alloy is added with hydrogen, subjected to a solution treatment (solution heat treatment) while heated and kept under oxidation atmosphere, cooled and then subjected to an aging treatment and a dehydrogenation treatment, whereby a homogeneous acicular structure is formed, high tension strength and high fatigue strength are implemented and workability is enhanced.

SUMMARY OF THE INVENTION

Technical Problem

As titanium alloy are known not only the near α type described above, but also α+β type (also expressed by α−β) and near α+β type titanium alloy. Titanium alloy of α+β type and near α+β type is excellent in strength, and has been expected to be actively used in various fields. However, titanium alloy of α+β type and near α+β type is different from titanium alloy of near α type in crystalline structure, and thus a desired result has not been obtained even by applying the method described in the above publication 1. Therefore, it has been strongly required to enhance the workability of titanium alloy of α+β type and near α+β type.

The present invention has been implemented in view of the foregoing circumstances, and has an object to provide material (titanium alloy) having excellent strength and workability by enhancing the workability of titanium alloy.

Solution to Problem

In order to attain the above object, according to the present invention, titanium alloy of α+β type or near α+β type is characterized in that the average particle diameter of crystal grains (average crystal grain size) is not more than 3.0 μm.

Here, the α+β type is also expressed by αβ type or α−β type.

According to the present invention, the superplastic property can be developed by reducing the particle size (diameter) of the crystal grains of titanium alloy, and thus superplastic forming can be performed. Accordingly, the workability of titanium alloy of α+β type and near α+β type can be greatly enhanced.

Furthermore, in the titanium alloy described above, the maximum particle size (diameter) of the crystal grains may be not more than 3.0 μm. In this case, the superplastic property of titanium alloy can be more remarkably enhanced.

Furthermore, in the titanium alloy described above, the average particle size of the crystal grains may be not more than 1.0 μm. In this case, the superplastic property of titanium alloy can be further enhanced.

Still furthermore, the titanium alloy described above may be at least one of Ti-3Al-2.5V, Ti-6Al-4V, Ti-6Al-6V-2Sn, Ti-6Al-2Sn-4Zr-6Mo alloy and Ti-4.5Al-3V-2Mo-2Fe.

Here, Ti-6Al-4V (Al: 6%, V: 4%) contains JIS 60 type (popularly named as 6-4 alloy) in Japanese Industrial Standards of Japan (*Grade* 5 *in ASTM Standards of U.S.A.*), JIS 60E type in Japanese Industrial standards (*Grade* 23 *in ASTM Standards of U.S.A.*) and other alloys having the same compositions. Furthermore, Ti-6Al-6V-2Sn contains AMS4918, AMS4936, AMS4937, AMS4971, AMS4978, AMS4979 and other alloys having the same compositions. Ti-6Al-2Sn-4Zr-6Mo alloy contains AMS4981 and other alloys having the same composition. Ti-4.5Al-3V-2Mo-2Fe contains AMS4964 and other alloys having the same composition.

According to the present invention, titanium alloy which has been widely used as material having high specific strength and excellent corrosion resistance is processed to develop superplastic property, whereby superplastic forming based on widely-used titanium alloy can be performed.

Furthermore, in order to attain the above object, according to the present invention, there is provided titanium alloy that is brought with a superplastic property by subjecting the titanium alloy to a treatment containing a hydrogen storage step for making the titanium alloy store hydrogen therein, a solution-treatment step for heating the titanium alloy which have stored in the hydrogen storage step, thereby applying solution-treatment to the hydrogen-stored titanium alloy, a cooling step for cooling the heated hydrogen-stored titanium alloy to develop martensitic transformation in the hydrogen-stored titanium alloy, a hot rolling step for heating the martensitic-transformed titanium alloy to a temperature not more than a predetermined transformation point and hot-rolling the martensitic-transformed titanium, and a dehydrogenation step for dehydrogenating the hot-rolled titanium alloy.

According to the present invention, titanium alloy is made to store (absorb) hydrogen, subjected to martensitic transformation and then hot-rolled to micronize crystal grains, thereby bringing the titanium alloy with the superplastic property. Accordingly, superplastic forming of titanium alloy can be performed, and the workability of titanium alloy can be enhanced.

Furthermore, in the titanium alloy described above, titanium alloy of α+β type or near α+β type is used as the above titanium alloy, and the average particle size (diameter) of the crystal grains after the dehydrogenation step is equal to 3.0 μm or less.

According to the present invention, the crystals are micronized by conducting hot rolling on titanium alloy so that the average particle diameter of the crystal grains is equal to 3.0 μm or less, so that an excellent superplastic property can be provided to the titanium alloy. When this titanium alloy is used for parts for transport equipment or parts for machines, for example, tanks and pressure containers can be manufactured by plastic forming. Accordingly, there can be provided materials which have excellent chemical resistance and corrosion resistance and can perform weight saving.

Furthermore, in the above titanium alloy, the hydrogen storage step comprises a step of heating the titanium alloy under inert gas stream, a step of switching the inert gas stream to hydrogen gas stream after the temperature reaches a processing temperature which is set in a temperature range from not less than 823K (550° C.) to not more than 1223K (950° C.), a step of elapsing a predetermined time under the hydrogen gas stream in the temperature range, a step of switching the hydrogen gas stream to the inert gas stream, and a step of cooling the titanium alloy.

According to the present invention, the amount of hydrogen to be stored (absorbed) in the hydrogen storage step can be properly controlled, and titanium alloy having stable quality can be obtained.

Furthermore, in the above titanium alloy, the solution-treatment step contains a treatment of heating the titanium alloy at a temperature equal to β-transformation point or more in the air and keeping the titanium alloy at the temperature equal to the β-transformation point or more for a predetermined time or more.

According to the present invention, the martensitic transformation can be made to surely progress in the titanium alloy having hydrogen stored therein. Furthermore, oxide film can be formed on the surface of the titanium alloy because the titanium alloy is heated in the air, so that discharge of hydrogen stored in the titanium alloy can be prevented and the martensitic transformation can be made to more surely progress.

Furthermore, in the above titanium alloy, the hot rolling step contains a step of heating the titanium alloy at a temperature of not more than β-transformation point and not less than normal temperature in the air and hot-rolling the titanium alloy to pulverize martensite of the titanium alloy, form high-density transfer region in the titanium alloy and deposit hydride.

According to the present invention, the crystals of the martensite-transformed titanium alloy can be more surely micronized. Furthermore, the hot rolling can be performed in the air, so that discharge of hydrogen stored in the titanium alloy can be prevented.

Still furthermore, in the above titanium alloy, the dyhydrogenating step contains a treatment of removing the oxide film on the surface of the titanium alloy which has been treated in the hot rolling step, and a treatment of heating the oxide-film-removed titanium alloy to at least a processing temperature or more in vacuum, wherein the processing temperature is set in a range from 823K (550° C.) to 973K (700° C.) and keeping the oxide-film-removed titanium alloy for a predetermined time at the processing temperature or more.

According to the present invention, hydrogen is removed from the titanium alloy and recrystallized grains can be surely formed, so that titanium alloy having a superplastic property can be obtained.

In order to attain the above object, according to the present invention, a method of manufacturing titanium alloy having a superplastic property comprises a hydrogen storing step for making the titanium alloy store hydrogen therein, a solution-treatment step for heating the titanium alloy which have stored in the hydrogen storage step, thereby applying solution-treatment to the hydrogen-stored titanium alloy, a cooling step for cooling the heated hydrogen-stored titanium alloy to develop martensitic transformation in the hydrogen-stored titanium alloy, a hot rolling step for heating the martensitic-transformed titanium alloy to a temperature not more than a predetermined transformation point and hot-rolling the martensitic-transformed titanium, and a dehydrogenation step for dehydrogenating the hot-rolled titanium alloy.

According to the present invention, the titanium alloy is made to store (absorb) hydrogen, subjected to martensitic transformation and hot-rolled, whereby crystal grains of the titanium alloy can be micronized and brought with the superplastic property. Accordingly, superplastic forming of titanium alloy can be performed, and the workability of titanium alloy can be enhanced.

Furthermore, in order to attain the above object, a method of processing titanium alloy of α+β type or near α+β type comprises a step of deforming the titanium alloy at an initial strain rate from $10^{-3}s^{-1}$ to $10^{-1}s^{-1}$.

According to the present invention, various products using titanium alloy as material can be manufactured by plastic forming. For example, parts for transport equipment, parts for machines, sanitary appliances, etc. which are excellent in chemical proof and corrosion resistance and light in weight can be manufactured.

Still furthermore, in the method of processing the titanium alloy, the titanium alloy is deformed at a temperature which is not less than 850K and not more than 1150K.

According to this invention, plastic forming can be performed with a high coefficient of extension.

Advantageous Effects of Invention

According to the present invention, the superplastic property can be developed by micronizing the crystal grains of titanium alloy, and thus superplastic forming can be performed. Accordingly, the workability of titanium alloy of α+β type and near α+β type can be greatly enhanced.

Furthermore, the superplastic property of titanium alloy can be more remarkably enhanced.

Still furthermore, titanium alloy which is widely used as material having high specific strength and excellent corrosion resistance is processed to develop the superplastic property thereof, whereby superplastic forming based on general-purpose titanium alloy can be performed.

The crystal grains of titanium alloy are micronized, whereby the titanium alloy can be brought with the superplastic property. Accordingly, the superplastic forming of titanium alloy can be performed, and the workability of titanium alloy can be enhanced.

Furthermore, titanium alloy can be brought with the excellent superplastic property. When this titanium alloy is used as parts for transport equipment or parts for machines, for example, a tank, a pressure container, etc. can be manufactured by superplastic forming. Accordingly, materials which are excellent in chemical resistance and corrosion resistance and can perform weight reduction can be provided.

Still furthermore, the amount of hydrogen to be stored (absorbed) in the hydrogen storing step can be properly controlled, and titanium alloy which is stable in quality can be obtained.

According to the present invention, transformation to martensite can be made to surely progress in hydrogen-stored titanium alloy. Furthermore, the hydrogen-stored titanium alloy is heated in the air, and thus oxide film is formed on the surface of the titanium alloy, so that the hydrogen stored in the titanium alloy can be prevented from discharging from the titanium alloy, and thus the transformation to martensite can be more surely performed.

The crystal grains of the martensite-transformed titanium alloy can be more surely micronized. Furthermore, the discharge of hydrogen stored in titanium alloy can be prevented because the titanium alloy is subjected to hot rolling in the air.

Titanium alloy having the superplastic property can be obtained by removing hydrogen from the titanium alloy and surely forming recrystallized grains.

Various kinds of products using titanium alloy as materials (raw materials) can be manufactured by superplastic forming. For example, there can be manufactured parts for transport equipment, parts for machines, sanitary appliances, etc. which are excellent in chemical resistance and corrosion resistance and can perform weight reduction. Furthermore, superplastic forming can be performed with a high coefficient of extension.

BRIEF DESCRIPTION OF THE DRAWINGS

FIG. 15A shows a table 1 representing the measurement results of the embodiments and the comparative examples which are put together, and FIG. 15B shows a table 2 representing the measurement results shown in FIGS. 13 and 14 which are put together.

DETAILED DESCRIPTION OF THE INVENTION

Figure 1:
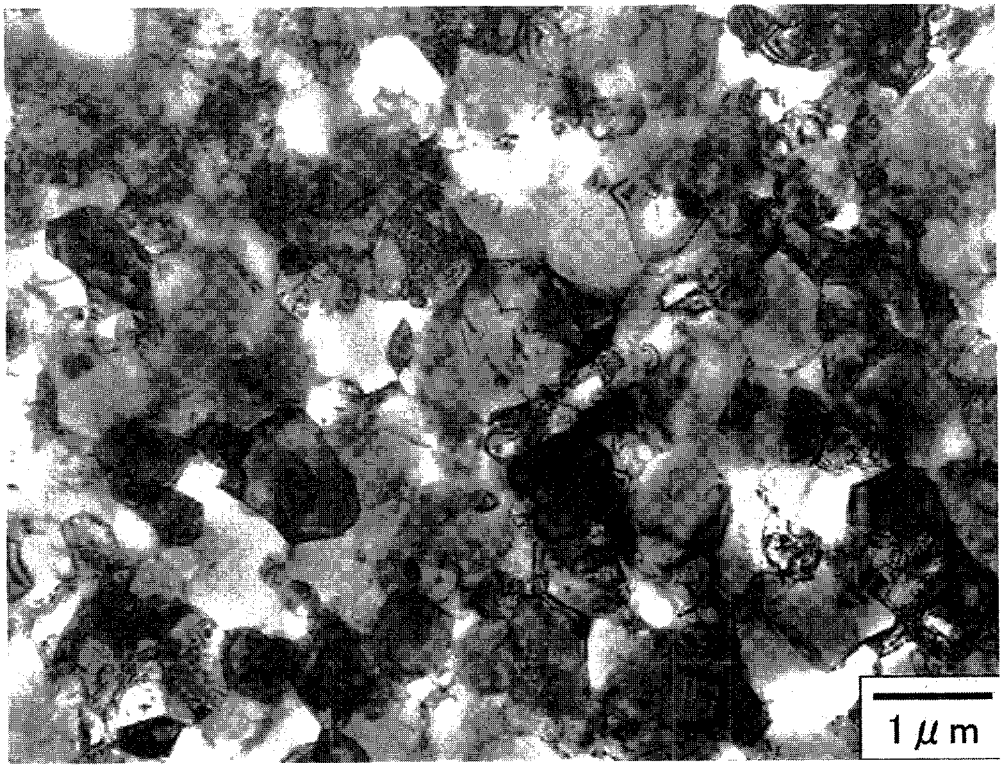
FIG. 1 is a TEM photograph of an example of titanium alloy to which the present invention is applied.

An embodiment to which the present invention is applied with be described hereunder with reference to the drawings.

Inventors of this application have reached a technical idea that plastic forming of titanium alloy can be performed by micronizing the crystal grains of the titanium alloy. Titanium alloy whose crystal grains are micronized has remarkably higher plastic forming performance (superplastic forming performance) as described later than generally known pure titanium or titanium alloy, and various shapes of titanium alloy can be molded out of the titanium alloy by press working, for example. Advantageous characteristics of titanium alloy that the specific strength is high and resistance to corrosion is excellent are maintained even after the crystal particles thereof are micronized. Therefore, the titanium alloy is effectively used as parts for vehicles such as a two-wheeled vehicle, a four-wheeled vehicle, etc., parts used in aeronautic/space fields, raw materials in medical application, etc.

According to this embodiment, titanium alloy having a superplastic property is preferable as titanium alloy whose crystal grains are micronized, and in order to attain titanium alloy having the superplastic property, titanium alloy (preferably, titanium alloy of $\alpha+\beta$ type or near $\alpha+\beta$ type) is subjected to a treatment containing a hydrogen storing (adsorbing) step for making the titanium alloy store (adsorb) hydrogen therein, a solution-treatment step for heating the titanium alloy in which hydrogen has been stored in the hydrogen storage step, thereby applying a solution treatment to the hydrogen-stored titanium alloy, a cooling step for cooling the heated hydrogen-stored titanium alloy to develop martensitic transformation in the hydrogen-stored titanium alloy, a hot rolling step for heating the martensitic-transformed titanium alloy to a temperature not more than a predetermined transformation point and hot-rolling the martensitic-transformed titanium, and a dehydrogenation step for dehydrogenating the hot-rolled titanium alloy.

The crystal grains of titanium alloy can be effectively micronized by making titanium alloy as raw material adsorb hydrogen, martensite-transforming the titanium alloy and hot-rolling the martensite-transformed titanium alloy.

Preferably, the hydrogen storing (absorbing) step contains a step of heating the titanium alloy under inert gas atmosphere, a step of switching the inert gas atmosphere to hydrogen gas atmosphere and keeping the titanium alloy under the hydrogen gas atmosphere when the temperature reaches a processing temperature which is set in a temperature range from not less than 823K (550° C.) to not more than 1223K (950° C.), a step of elapsing a predetermined time while keeping the titanium alloy under the hydrogen gas atmosphere in the temperature range (i.e., keeping the titanium alloy in the temperature range under the hydrogen gas atmosphere for a predetermined time), a step of switching the hydrogen gas atmosphere to the inert gas atmosphere and keeping the titanium alloy under the inert gas atmosphere, and a step of cooling the titanium alloy.

More preferably, the hydrogen storing (absorbing) step contains a step of heating the titanium alloy under an inert gas stream (flow), a step of switching the inert gas stream to a hydrogen gas stream (flow) and keeping the titanium alloy under the hydrogen gas stream when the temperature reaches a processing temperature which is set in a temperature range from not less than 823K (550° C.) to not more than 1223K (950° C.), a step of elapsing a predetermined time while keeping the titanium alloy under the hydrogen gas stream at a temperature set in the temperature range, a step of switching the hydrogen gas stream to the inert gas stream and keeping the titanium alloy under the inert gas stream, and a step of cooling the titanium alloy.

Furthermore, the step of elapsing the predetermined time while keeping the titanium alloy under the hydrogen gas stream to make the titanium alloy store (absorb) hydrogen may be executed at a temperature set in the temperature range from not less than 823K to not more than 1223K. The temperature in this step may be identical to or different from the processing temperature at which the inert gas stream is switched to the hydrogen gas stream.

More preferably, the temperature of the titanium alloy is once decreased to a room temperature while the titanium alloy is left cooled or air-cooled after the hydrogen storing (absorbing) step.

Furthermore, the amount of hydrogen to be stored (absorbed) preferably ranges from not less than 0.1 wt % to not more than 0.5 wt %, and is more preferably equal to 0.3 wt %.

The inert gas used in the hydrogen storing (absorbing) step may be selected from argon, helium, nitrogen or the like. The pressure of the inert gas stream may be equal to 0.005 MPa, for example, and the pressure of the hydrogen gas stream may be equal to 0.005 MPa, for example.

As described above, the atmosphere under which the titanium alloy is kept at a temperature set in the temperature range from not less than 823K to not more than 1223K is shifted from the inert gas atmosphere (stream) to the hydrogen atmosphere (stream), whereby hydrogen gas can be surely and sufficiently stored (absorbed) in the titanium alloy. Furthermore, the titanium alloy as raw material is heated under the inert gas atmosphere (stream), and thus the titanium alloy is exposed to hydrogen when the temperature reaches a temperature at which hydrogen is surely stored (absorbed) in the titanium alloy. Therefore, occurrence of uncertain storage (absorption) of hydrogen can be prevented, and the amount of hydrogen to be stored (absorbed) in titanium alloy can be surely controlled to a proper amount. Furthermore, by switching the inert gas atmosphere (stream) to the hydrogen gas atmosphere (stream), start and end of the hydrogen storage (absorption) can be easily controlled. Accordingly, titanium alloy having stable quality can be obtained.

The temperature at which the atmosphere (under which the titanium alloy is put) is shifted from the inert gas atmosphere (stream) to the hydrogen atmosphere (stream), and the temperature at which the predetermined time elapses while the titanium alloy is kept under the hydrogen atmosphere (stream) may be more preferably set to a β-transformation point of the titanium alloy or less. In this case, the progress of the solution treatment during the storage (absorption) of hydrogen into titanium alloy is not promoted. Therefore, the martensitic transformation of titanium alloy can be surely controlled. This temperature is more preferably set to 1073K (800° C.) or more, and most preferably set to 1073K because the hydrogen storage (absorption) speed and efficiency are increased.

The solution-treatment step preferably contains a step of heating the titanium alloy to a temperature of the β transformation point or more under the air atmosphere and keeping the titanium alloy at the temperature of the β transformation point or more for a predetermined time or more. The martensitic transformation of titanium alloy can be surely and sufficiently progressed by keeping the hydrogen-stored titanium alloy at the temperature of the β transformation point or more. Furthermore, the titanium alloy is heated under the air atmosphere in the solution-treatment step, and thus oxide coating (film) is formed on the surface of the titanium alloy. Therefore, the hydrogen stored in the titanium alloy can be prevented from being discharged from the titanium alloy in the solution-treatment step, and the martensitic transformation can be more surely progressed. It is more preferable that the titanium alloy is once cooled to the room temperature by air cooling or water cooling.

The hot-rolling step preferably contains a step of heating the titanium alloy at a temperature in the range from not less than the normal temperature to not more than the β transformation point under the air atmosphere and rolling the titanium alloy to pulverize the martensite of the titanium alloy, thereby forming a high-density transition region and depositing hydride. In this hot-rolling step, the crystals of the titanium alloy transformed to martensite in the solution-treatment step can be more surely micronized. Furthermore, the hot rolling is performed under the air atmosphere, so that the oxide film on the surface of the titanium alloy is kept. Therefore, the crystal grains can be micronized with preventing discharge of hydrogen stored in the titanium alloy by the oxide film. The temperature condition in the hot-rolling step is more preferably set in the temperature range from not less than 773K (500° C.) to not more than 923K (650° C.). When the temperature is less than 773K, it is difficult to increase the draft (rolling reduction), and the draft can be increased to, for example, 80% or more by setting the temperature to 773K or more, so that the crystal grains can be more finely micronized. Furthermore, by setting the temperature to 923K or less, coarsening of the crystal grains can be prevented. It is more preferable that the titanium alloy is once cooled to the room temperature by air cooling after the hot-rolling step.

The dehydrogenating step preferably contains a step of removing the oxide film on the surface of the titanium alloy treated in the hot-rolling step, and a step of heating the oxide-film-removed titanium alloy to a processing temperature or more under vacuum and keeping the titanium alloy at the processing temperature or more for a predetermined time, wherein the processing temperature is set at least in the temperature range from not less than 823K (550° C.) to not more than 923K (700° C.). Through this treatment, hydrogen can be removed from the titanium alloy, and recrystallized grains can be surely formed. Furthermore, the temperature condition in the dehydrogenating step is set to 973K or less, whereby coarsening of crystal grains can be prevented. Still furthermore, when the temperature condition in the dehydrogenating step is set to 873K or more, hydrogen can be more surely removed from the titanium alloy, and this is most preferable. In the dehydrogenating step, after the titanium alloy is kept at the predetermined temperature described above for a predetermined time, the titanium alloy is left cooled preferably to a temperature less than 873K, and more preferably to the room temperature in a furnace under vacuum.

Titanium alloy of α+β type or near α+β type is used as a raw material for obtaining titanium alloy whose crystal grains are micronized through the above treatment. More specifically, titanium alloy to be treated as the raw material is any material selected from the group consisting of Ti-3Al-2.5V, Ti-6Al-4V (containing JIS 60 type, JIS 60E type and other alloys of the same compositions), Ti-6Al-6V-2Sn (containing AMS4918, AMS4936, AMS4937, AMS4971, AMS4978, AMS4979 and other alloys of the same compositions), Ti-6Al-2Sn-4Zr-6Mo (containing AMS4981 and other alloys of the same compositions) and Ti-4.5Al-3V-2Mo-2Fe (AMS4964 and other alloys of the same compositions), and it is treated as described above, whereby the titanium alloy whose crystal grains are micronized as described above is obtained.

With respect to the titanium alloy of α+β type or near α+β type, the draft (rolling reduction) can be set to 80% or more in the hot-rolling step. By hot-rolling the titanium alloy under such a high draft, the crystal grains can be made more fine (i.e., more finely micronized).

It is preferable that the average particle diameter (average grain size) of the crystal grains after the dehydrogenating step is equal to 3.0 μm or less, it is more preferable that the maximum particle diameter of the crystal grains is equal to 3.0 μm or less, and it is most preferable that the average particle diameter of the crystal grains is equal to 1.0 μm or less.

FIG. 1 is a TEM (Transmission Electron Microscope) photograph showing a crystal state with respect to an example of titanium alloy to which the present invention is applied. Titanium alloy shown in FIG. 1 is obtained by using Ti-6Al-6V-2Sn alloy as an example of titanium alloy of α+β type and conducting a treatment of a first embodiment described later on the titanium alloy.

With respect to the crystal grains of the titanium alloy shown in FIG. 1, as is apparent from the scale in FIG. 1, the particle diameters (sizes) of most of crystal grains are in the range from 0.3 μm to 0.5 μm, and the particle diameter (size) of large crystal grains is equal to about 1 μm. The average particle diameter (size) is equal to 1.0 μm or less.

Figure 2:
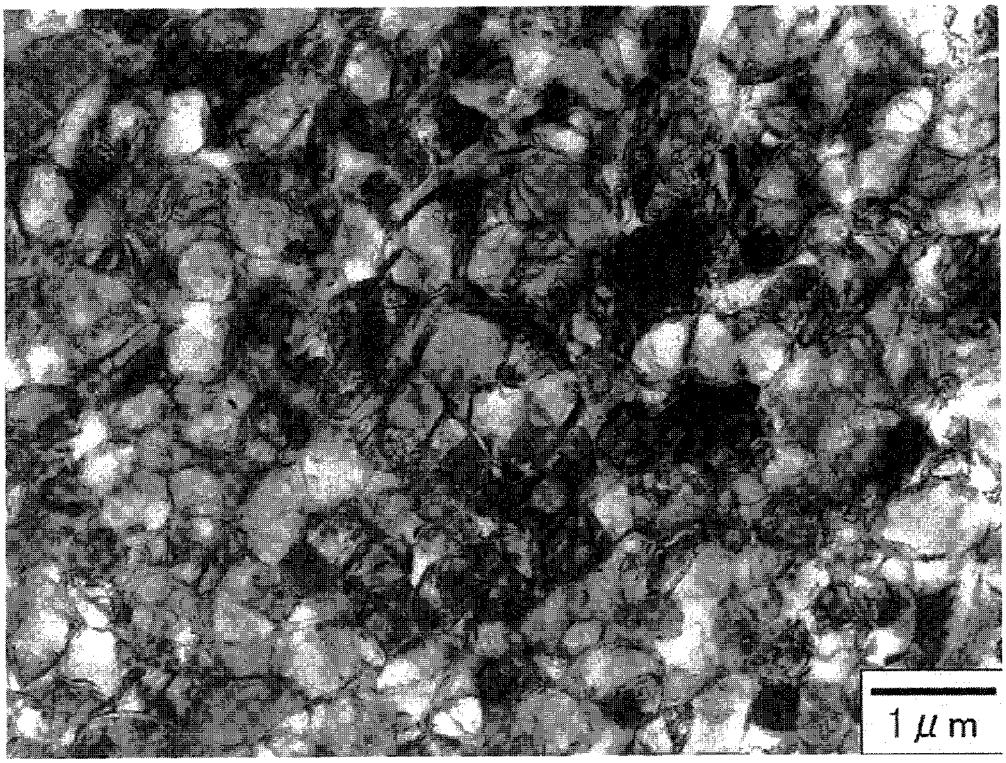
FIG. 2 is a TEM photograph of another example of titanium alloy to which the present invention is applied.

FIG. 2 is a TEM photograph showing a crystal state with respect to another example of titanium alloy to which the present invention is applied. The titanium alloy shown in FIG. 2 is obtained by using Ti-4.5Al-3V-2Mo-2Fe alloy as an example of titanium alloy of α+β type and conducting a treatment of a second embodiment described later on the titanium alloy.

With respect to the crystal grains of titanium alloy shown in FIG. 2, as is apparent from the scale in FIG. 2, the particle diameters (sizes) of most of crystal grains are in the range from 0.3 μm to 0.5 μm, and the particle size of large crystal grains is less than 1 μm.

By merely rolling titanium alloy such as Ti-6Al-6V-2Sn alloy, Ti-4.5Al-3V-2Mo-2Fe alloy or the like, it is impossible to micronize the crystal grains thereof so that the average particle diameter decreases to 1.0 μm.

For example, in the case of Ti-6Al-6V-2Sn alloy obtained as a first comparative example described later, that is, Ti-6Al-6V-2Sn alloy which was merely hot-rolled at the temperature of 923K (650° C.) with the draft (rolling reduction) of 80% under the air atmosphere, the crystal grains thereof were visually measured on the basis of the TEM photograph thereof after the hot rolling, and the average particle diameter of the crystal grains was measured to be equal to about 10 μm. Likewise, in the case of Ti-4.5Al-3V-2Mo-2Fe alloy obtained as a second comparative example described later, that is, Ti-4.5Al-3V-2Mo-2Fe which was merely hot-rolled under the same condition as the first comparative example, the crystal grains were visually measured on the basis of the TEM photograph thereof after the hot rolling, and the average particle diameter of the crystal grains was measured to be equal to about 10 μm.

That is, it is possible to perform the micronization of the crystal grains as shown in FIGS. 1 and 2 by conducting the treatment of the present invention on titanium alloy of α+β type or near α+β type.

Figure 3:
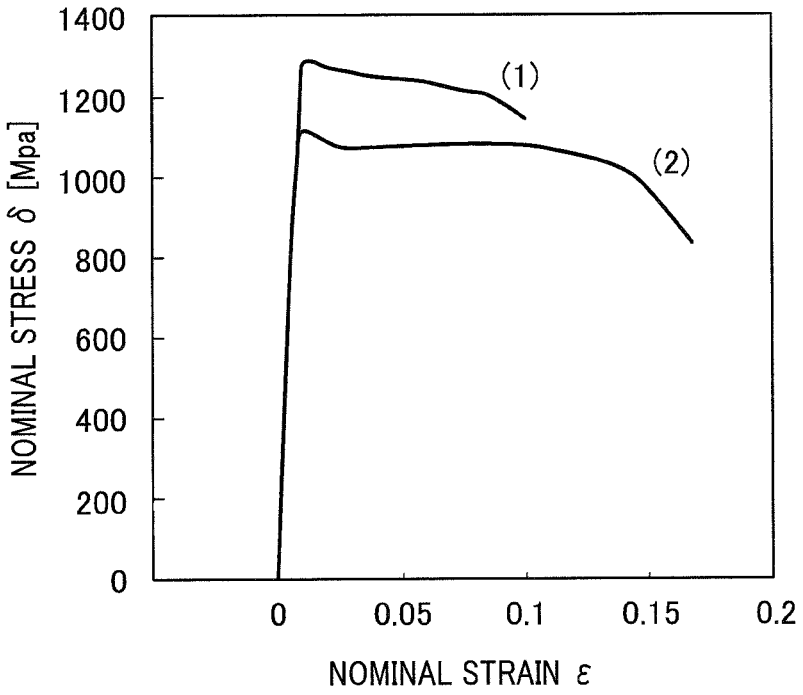
FIG. 3 is a graph representing the characteristic of an example of titanium alloy.

FIG. 3 is a graph showing the characteristic of titanium alloy, and specifically shows a stress-strain diagram (curve) in which the axis of ordinate represents nominal stress δ [MPa] and the axis of abscissa represents nominal strain ε. In FIG. 3, (1) and (2) represent the characteristics of titanium alloy obtained according to the first embodiment, wherein (1) represents the characteristic of titanium alloy when the average particle diameter of crystal grains is equal to 0.40 μm, and (2) represents the characteristic of titanium alloy when the average particle diameter of crystal grains is equal to 2.1 μm. The stress-strain diagram (curve) of FIG. 3 is obtained according to a tensile (tension) test described later.

Both of (1) and (2) are the characteristics of Ti-6Al-6V-2Sn alloy. However, the particle sizes (diameters) of the crystal grains of (1) and (2) are different from each other as described above, and it is estimated that (1) corresponds to "fine particles" and (2) corresponds to "rough particles". The yield point (breakdown point) of the titanium alloy of (1) is significantly higher than that of the titanium alloy of (2), but both the yield points exceed 1000 MPa.

Figure 4:
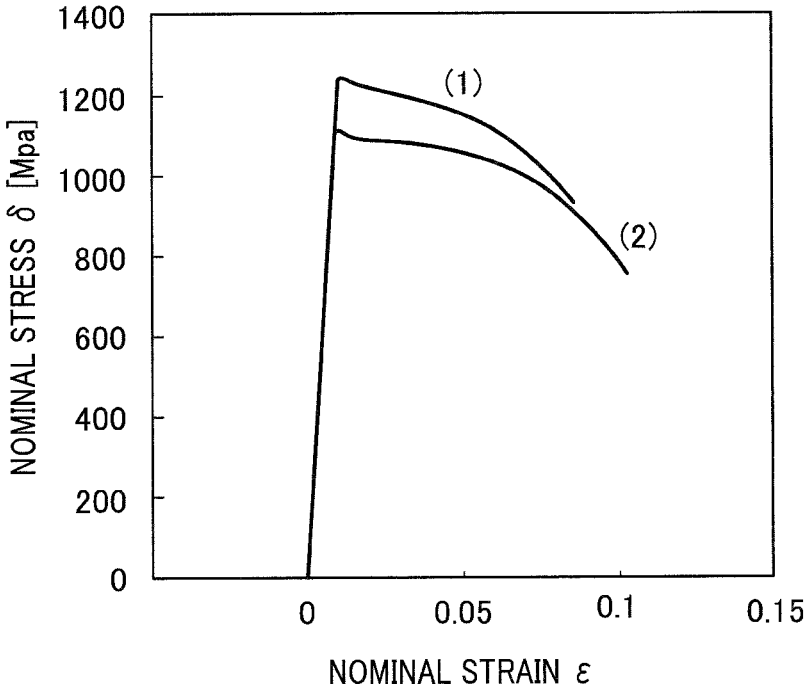
FIG. 4 is a graph representing the characteristic of another example of titanium alloy.

Likewise, FIG. 4 is a graph showing the characteristic of titanium alloy, and specifically shows a stress-strain curve in which the axis of ordinate represents nominal stress δ [MPa.] and the axis of abscissa represents nominal strain ε. In FIG. 4, (1) and (2) represent the characteristics of titanium alloy obtained according to a second embodiment described later, wherein (1) represents the characteristic of titanium alloy when the average particle diameter of crystal grains is equal to 0.26 μm, and (2) represents the characteristic of titanium alloy when the average particle diameter of crystal grains is equal to 0.58 μm. The stress-strain curve of FIG. 4 is obtained according to the tensile test described later.

Both of (1) and (2) are the characteristics of Ti-4.5Al-3V-2Mo-2Fe alloy. However, the particle sizes of the crystal grains of (1) and (2) are different from each other as described above, and it is estimated that (1) corresponds to "fine particles" and (2) corresponds to "rough particles". The yield point (breakdown point) of the titanium alloy of (1) is significantly higher than that of the titanium alloy of (2), but both the yield points exceed 1000 MPa.

As is apparent from FIGS. 3 and 4, the titanium alloy obtained by subjecting titanium alloy of α+β type to the treatment containing the hydrogen storing (adsorbing) step, the solution-treatment step, the cooling step, the hot rolling step and the dehydrogenating step has specific strength which is the same level as or higher level than the specific strength of general titanium alloy of α+β type which is not subjected to the above treatment irrespective of the difference in particle diameter. That is, the specific strength is not reduced by the above treatment, and availability (utility) of titanium alloy as a raw material is enhanced because superplasticity (superplastic property) is provided to the titanium alloy as described later through the above treatment.

Figure 5:
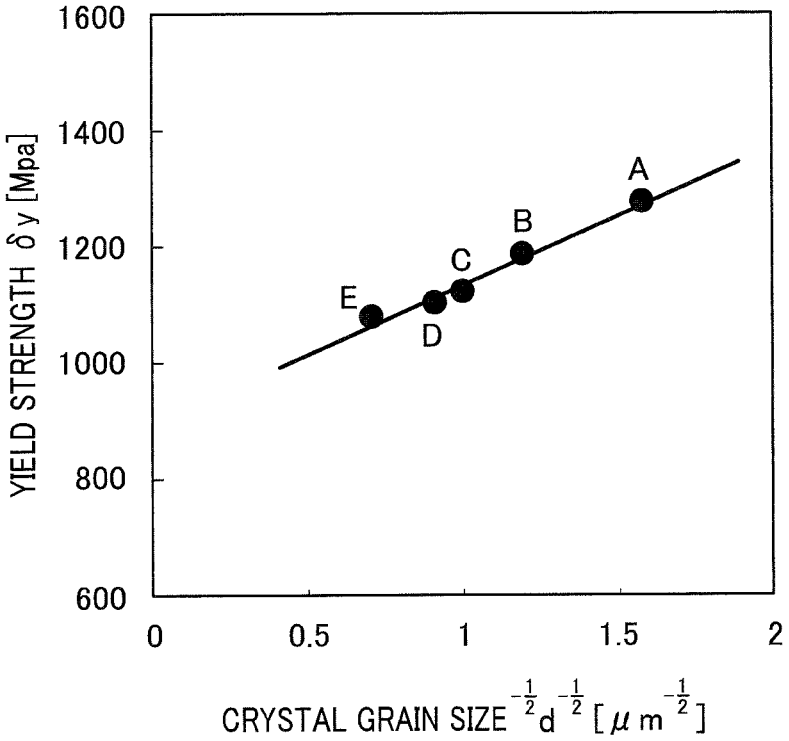
FIG. 5 is a graph showing the correlation between the crystal grain diameter (size) and yield strength of titanium alloy.
Figure 6:
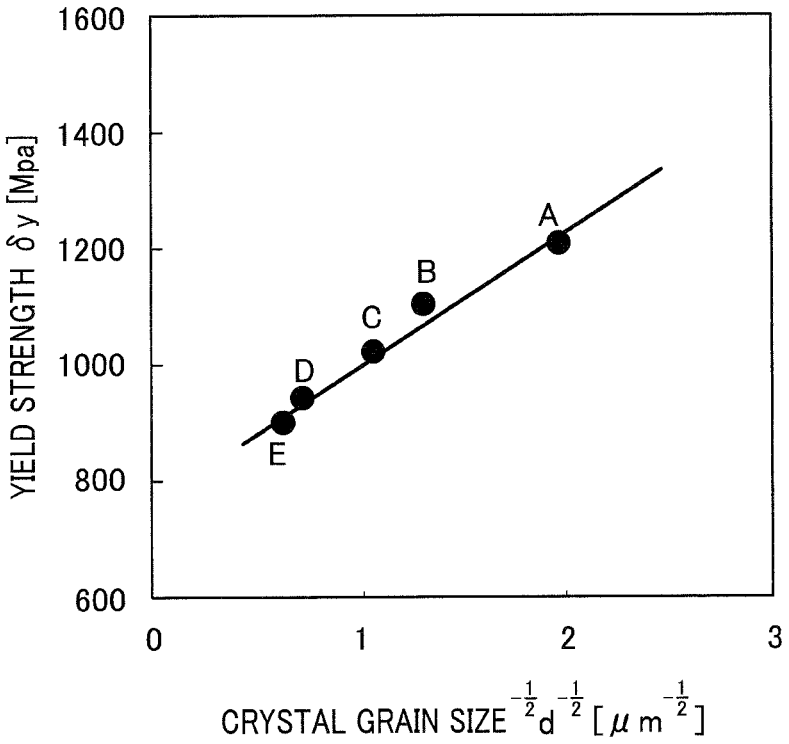
FIG. 6 is a graph showing the correlation between the crystal grain diameter and the yield strength of titanium alloy.

FIGS. 5 and 6 are graphs showing the correlation between the crystal particle diameter (size) of titanium alloy and the yield strength in which the axis of ordinate represents the yield strength $\delta_y$ [MPa] and the axis of abscissa represents the crystal particle diameter $d^{-1/2}$[$\mu m^{-1/2}$]. FIG. 5 is a graph in which the average particle diameter and yield strength of Ti-6Al-6V-2Sn alloy obtained by the same treatment as the first embodiment are plotted. The yield strength was measured by the tensile test described later. The crystal particle diameter can be varied by adjusting the draft (rolling reduction) in the hot rolling step. Furthermore, FIG. 6 is a graph in which the average particle diameter of Ti-4.5Al-3V-2Mo-2Fe alloy obtained by the same treatment as the second embodiment and the yield strength measured by the tensile test described later are plotted.

The yield strengths at the respective particle diameters of A (average particle diameter of 0.40 μm), B (average particle diameter of 0.74 m), C (average particle diameter of 1.0 μm), D (average particle diameter of 1.2 μm) and E (average particle diameter of 2.1 μm) are plotted in FIG. 5. An approximate curve of the yield strength δy is represented by $\delta y=227.69d^{-1/2}+915$.

Furthermore, the yield strengths at the respective particle diameters of A (average particle diameter of 0.26 μm), B (average particle diameter of 0.58 μm), C (average particle diameter of 0.87 μm), D (average particle diameter of 1.9 μm) and E (average particle diameter of 2.5 μm) are plotted in FIG. 6. An approximate curve of the yield strength δy is represented by $\delta y=210d^{-1/2}+793$.

As is apparent from FIGS. 5 and 6, there is a tendency that the yield strength increases as the particle diameter of crystal grains of titanium alloy is more finely micronized. The average particle diameter of crystal grains is less than 1.0 μm in each of the examples shown in FIGS. 3 and 4, and those materials which increase in specific strength as the particle diameter of crystal grains is higher can be obtained. Therefore, a preferable particle diameter range of crystal grains of titanium alloy is not more than 1.0 μm.

Next, the superplastic forming of the titanium alloy will be described.

According to a method of processing the titanium alloy according to the present invention, titanium alloy of α+β type or near α+β type which is subjected to the above treatment according to the present invention is deformed at an initial strain rate of not less than $10^{-3}s^{-1}$ to not more than $10^{-1}s^{-1}$. In this case, the titanium alloy may be deformed at a temperature of not less than 850K to not more than 1150K. According to this processing method, the superplastic forming (processing) can be performed by actively using the superplastic property of the titanium alloy so as to obtain an extension (elongation) of about 2000% or more, and thus the titanium alloy can be processed into various shapes.

Figure 13:
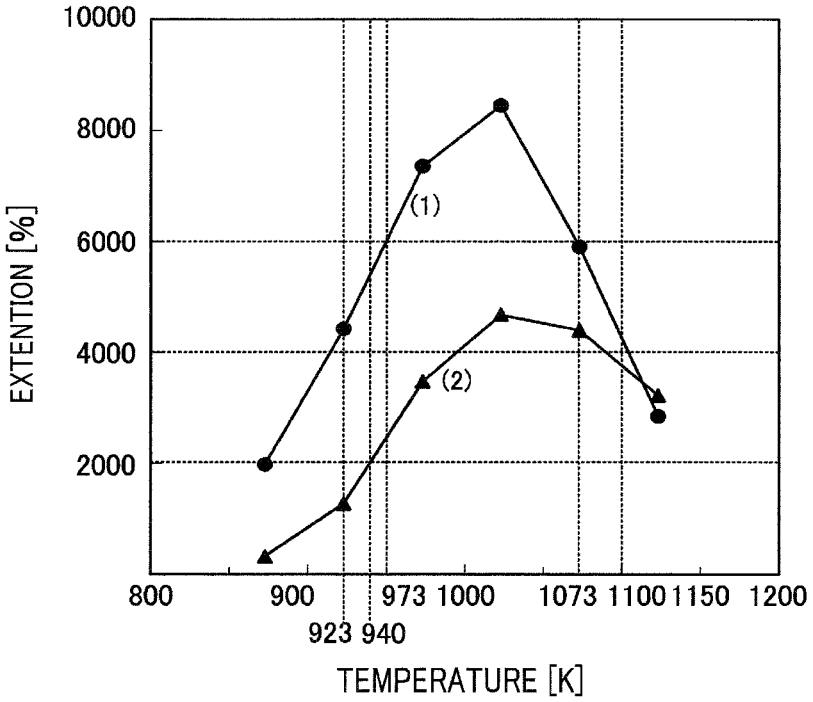
FIG. 13 is a graph showing an influence of temperature on the extension in a tensile test.
Figure 14:
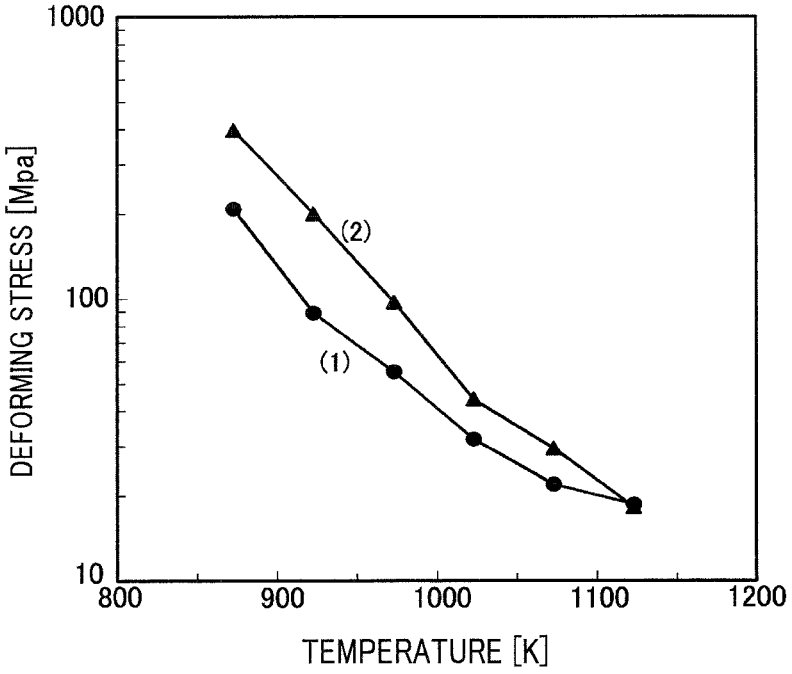
FIG. 14 is a graph showing the influence of temperature on the deforming stress in the tensile test.

FIGS. 7 to 12 are graphs showing the correlation between the initial strain rate [$s^{-1}$] and the extension (elongation) [%] or the deforming stress [MPa] in tensile (tension) tests of titanium alloy with variation of temperature. FIGS. 13 and 14 are graphs showing the influence of temperature on the extension and the deforming stress. In FIGS. 7 to 14, a test result of a test piece obtained according to the first embodiment is represented by (1), and a test result of a test piece obtained according to the comparative example 1 is represented by (2).

Figure 7:
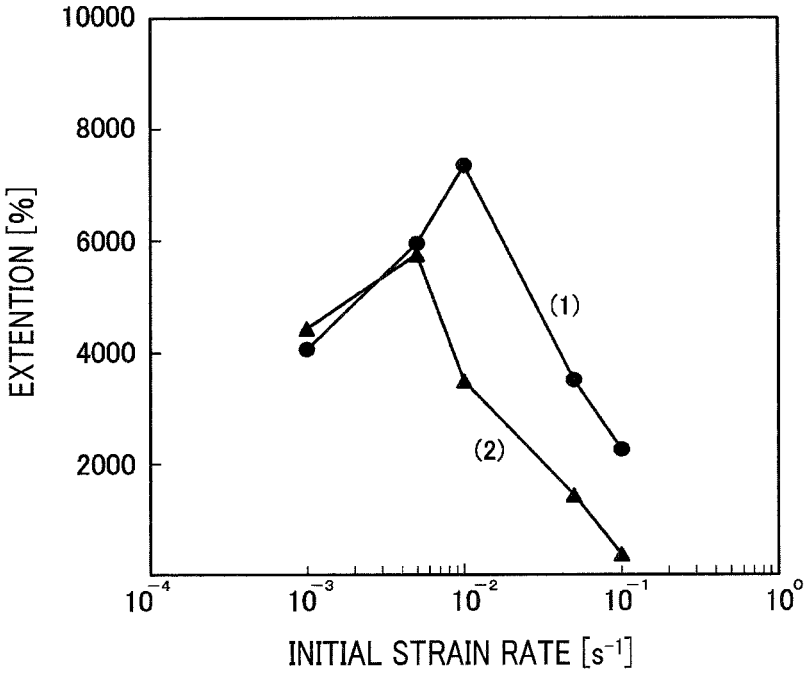
FIG. 7 is a graph showing the correlation between the initial strain rate and the extension in a tensile test.
Figure 8:
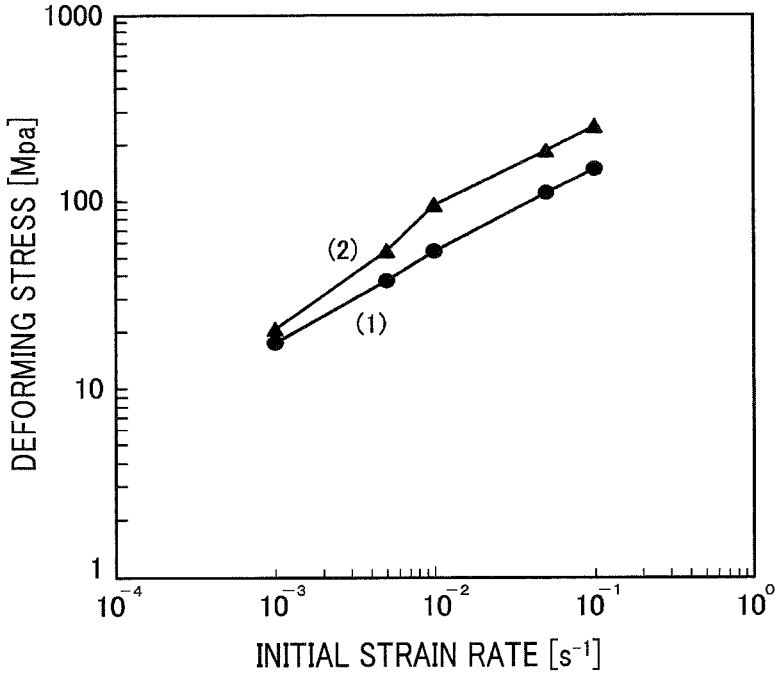
FIG. 8 is a graph showing the correlation between the initial strain rate and the deforming stress in the tensile test.

FIG. 7 shows the correlation between the initial strain rate and the extension when the temperature is set to 973K (700° C.), and FIG. 8 shows the correlation between the initial strain rate and the deforming stress when the temperature is set to 973K (700° C.)

The test piece of the first embodiment represented by (1) extended with an extension coefficient (percentage) of 2000% or more at an initial strain rate in the range from not less than $10^{-3}s^{-1}$ to not more than $10^{-1}s^{-1}$, and particularly greatly extended with an extension coefficient (percentage) of 6000% or more at an initial strain rate of $10^{-2}s^{-1}$. There is a tendency that the deforming stress is higher as the initial strain rate increases, but it stops at 151 MPa even when the initial strain rate is equal to $10^{-1}s^{-1}$. Accordingly, it is apparent that the superplastic forming can be easily performed even when the initial strain rate increases to $10^{-1}s^{-1}$. Furthermore, the test piece of the first comparative example represented by (2) greatly extended with an extension coefficient (percentage) of 2000% at an initial strain rate in the range from not less than $10^{-3}s^{-1}$ to not more than $10^{-2}s^{-1}$, but the deforming stress in this range is low.

Figure 9:
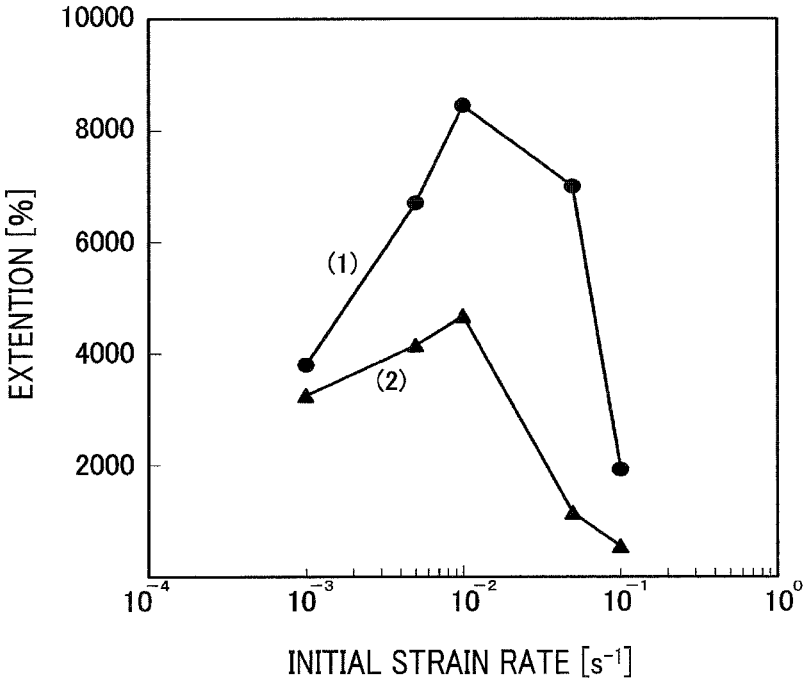
FIG. 9 is a graph showing the correlation between the initial strain rate and the extension (elongation) in the tensile test.
Figure 10:
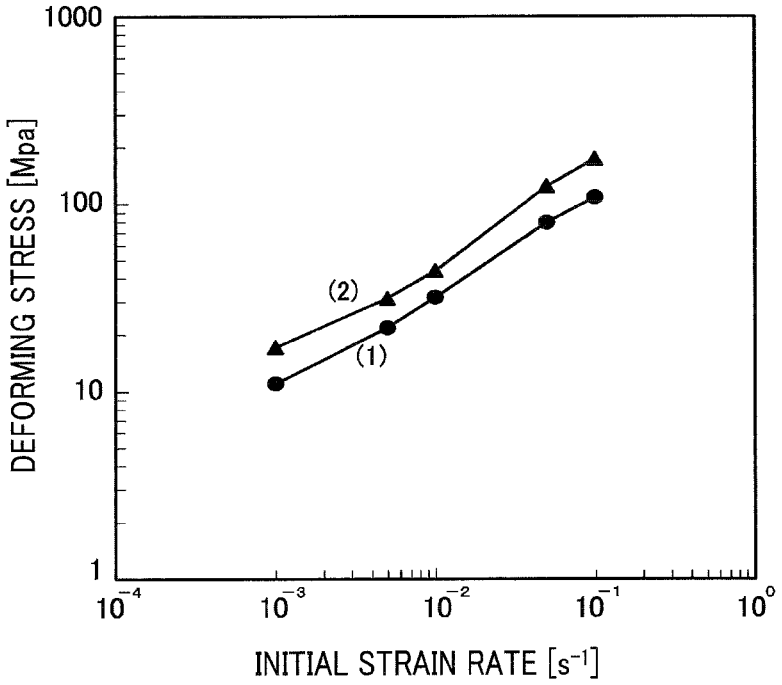
FIG. 10 is a graph showing the correlation between the initial strain rate and the deforming stress in the tensile test.

FIG. 9 shows the correlation between the initial strain rate and the extension when the temperature is set to 1023K (750° C.), and FIG. 10 shows the correlation between the initial strain rate and the deforming stress when the temperature is set to 1023K (750° C.).

The test piece of the first embodiment represented by (1) extended with an extension coefficient (percentage) of about 2000% or more at an initial strain rate in the range from not less than $10^{-3}s^{-1}$ to not more than $10^{-1}s^{-1}$, and particularly remarkably greatly extended with an extension coefficient (percentage) of 8000% or more at an initial strain rate of $10^{-2}s^{-1}$. There is a tendency that the deforming stress increases as the initial strain rate increases, but it stops at 108 MPa even when the initial strain rate is equal to $10^{-1}s^{-1}$. Accordingly, it is apparent that the superplastic forming can be easily performed even when the initial strain rate increases to $10^{-1}s^{-1}$. Furthermore, the test piece of the first comparative example represented by (2) greatly extended with an extension coefficient (percentage) of 2000% at an initial strain rate in the range from not less than $10^{-3}s^{-1}$ to not more than $10^{-2}s^{-1}$, but the deforming stress in this range is low.

Figure 11:
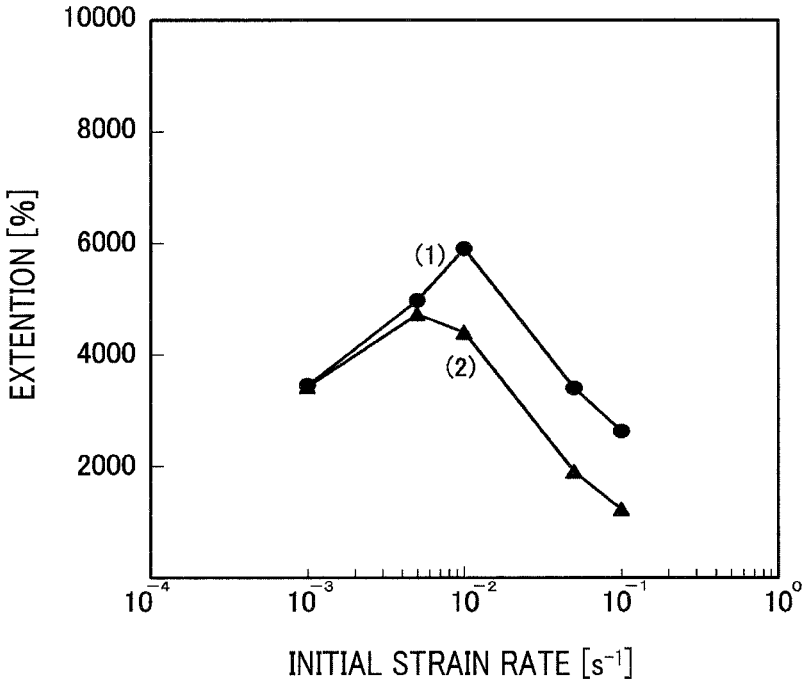
FIG. 11 is a graph showing the correlation between the initial strain rate and the extension in the tensile test.
Figure 12:
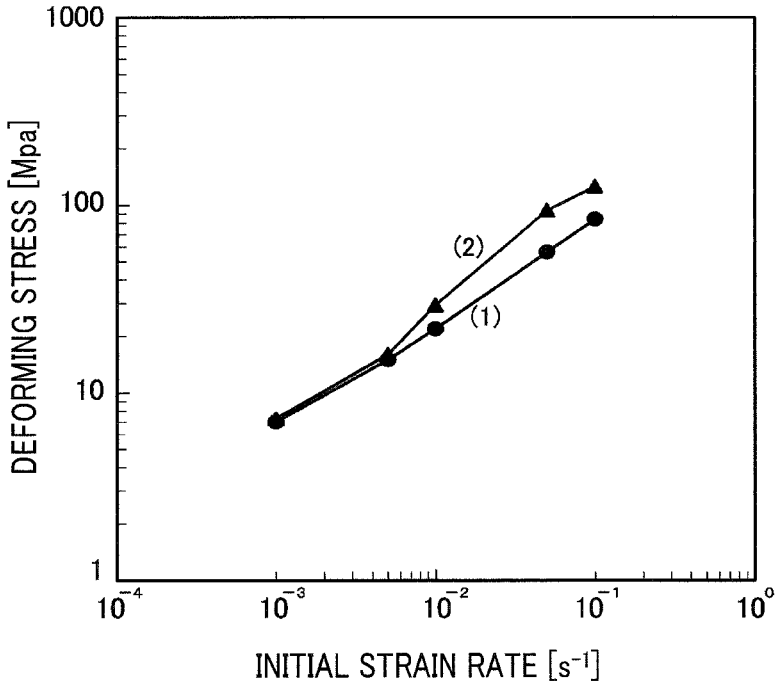
FIG. 12 is a graph showing the correlation between the initial strain rate and the deforming stress in the tensile test.

FIG. 11 shows the correlation between the initial strain rate and the extension when the temperature is set to 1073K (800° C.), and FIG. 12 shows the correlation between the initial strain rate and the deforming stress when the temperature is set to 1073K (800° C.).

The test piece of the first embodiment represented by (1) extended with an extension coefficient (percentage) of about 2000% or more at an initial strain rate in the range from not less than $10^{-3}s^{-1}$ to not more than $10^{-1}s^{-1}$, and particularly greatly extended with an extension coefficient (percentage) of 6000% or more at an initial strain rate of $10^{-2}s^{-1}$. There is a tendency that the deforming stress increases as the initial strain rate increases, but it stops at 84.2 MPa even when the initial strain rate is equal to $10^{-1}s^{-1}$. Accordingly, it is apparent that the superplastic forming can be easily performed even when the initial strain rate increases to $10^{-1}s^{-1}$. Furthermore, the test piece of the first comparative example represented by (2) greatly extended with an extension coefficient (percentage) of 2000% or more at an initial strain rate in the range from not less than $10^{-3}s^{-1}$ to not more than $10^{-2}s^{-1}$, but the deforming stress in this range is low.

FIG. 15A shows a table 1 representing the measurement results of the embodiments and the comparative examples which are put together. In the table 1, the unit of the initial strain rate is [$s^{-1}$], the unit of the extension (elongation) is [%] and the unit of the deforming stress is [MPa].

In the table 1, "micronized (fine) particle titanium alloy" corresponds to the test piece obtained according to the first embodiment and is represented by (1) in FIGS. 7 to 12. Furthermore, "rough (coarse) particle titanium alloy" corresponds to the test piece obtained according to the first comparative example and is represented by (2) in FIGS. 7 to 12.

As is apparent from the table 1, the test piece obtained according to the first embodiment extended with an extension coefficient of 2000% or more under almost all conditions, the strain rate sensitivity index (m value) greatly exceeds 0.3 as a reference value of superplasticity, so that the superplastic property appears.

Furthermore, the rough particle titanium alloy obtained according to the first comparative example 1 extended with an extension coefficient of 1000% or more at an initial strain rate in the range from not less than $10^{-3}$ to not more than $10^{-1}$, and the strain rate sensitivity index (m value) greatly exceeds 0.3. Accordingly, even when the rough particle titanium alloy is processed, the superplastic property is obtained.

As shown in FIG. 13, the test piece of the first embodiment of (1) extended with an extension coefficient of about 2000% or more in the temperature range from 850K to 1150K. Particularly, it extended with an extension coefficient of 4000% or more in the temperature range from not less than 923K to not more than 1100K, and extended with an extension coefficient of 6000% or more in the temperature range from not less than 950K to not more than 1073K. The test piece of the first comparative example of (2) extended with an extension coefficient of 2000% or more at the temperature of 940K or more, and extended with a high extension coefficient of 4000% or more in the temperature range from not less than 1000K to not more than 1100K.

As shown in FIG. 14, there is a tendency that the deforming stress decreases as the temperature is higher. At the temperature of 873K as the lowest test condition, the deforming stress of the test piece of the first comparative example is less than 400. Accordingly, the deforming stress was excellent in the whole temperature zone shown in FIG. 14.

FIG. 15B shows a table 2 representing the measurement results shown in FIGS. 13 and 14 which are put together and plotted.

The publicly known so-called superplastic forming (processing) means that the extension ranges from 500% to 1000%. As is apparent from samples in which the extension was equal to about 2000% in the results of the tables 1 and 2, those samples are apparently more excellent as compared with prior arts. Accordingly, the processing condition to obtain the extension of 2000% or more is preferable.

Furthermore, it is known that the extension of titanium alloy of $\alpha+\beta$ type which has been sold in the market is equal to about 2500% at maximum. Therefore, the processing condition for obtaining an extension larger than 2500%, for example, an extension of 4000% or more is more preferable. Still furthermore, the processing condition for obtaining an excellent extension of 6000% or more is most preferable.

In view of this point, from the results shown in FIGS. 7 to 12 and the table 1, when the initial strain rate is set in the range from not less than $10^{-3}s^{-1}$ to not more than $10^{-1}s^{-1}$, an extension of about 2000% or more was obtained from the test piece of the first embodiment, and also a high extension was obtained from even the test piece of the first comparative example. Therefore, this processing condition is preferable.

Furthermore, when the initial strain rate was set in the range from not less than $10^{-3}s^{-1}$ to not more than $10^{-2}s^{-1}$, the test piece of the first embodiment extended with an extension of about 4000% or more, and the test piece of the first comparative example also extended with an extension of about 3000%, so that this processing condition is more preferable.

Still furthermore, when the initial strain rate was set in the range from not less than $5\times10^{-3}s^{-1}$ to not more than $1\times10^{-2}s^{-1}$, the test piece of the first embodiment extended with an extension of about 6000% or more, so that this processing condition is most preferable.

From the results shown in FIGS. 13 and 14 and the table 2, when the temperature condition of the superplastic forming was set in the range from not less than 850K to not more than 1150K, the extension of 2000% or more could be obtained from the test piece of the first embodiment, and thus this temperature condition is preferable.

Furthermore, when the temperature condition of the superplastic forming was set in the range from not less than 923K to not more than 1100K, the extension of 4000% or more could be obtained from the test piece of the first embodiment, and thus this temperature condition is more preferable. When the temperature condition was set to 940K or more, the extension of 2000% or more was obtained from the test piece of the first comparative example, and thus this temperature condition is more preferable. When the temperature condition was set in the range from not less than 950K to not more than 1073K, a high extension of 6000% or more could be obtained from the test piece of the first embodiment, and thus the temperature condition is most preferable.

When the temperature condition was set to 923K or more, the deforming stress was equal to 90 MPa or less in the test piece of the first embodiment and 200 MPa or less in the test piece of the first comparative example, so that this temperature condition is also preferable in view of the easiness of processing.

As described above, according to the embodiments to which the present invention is applied, the superplastic property can be provided to titanium alloy of $\alpha+\beta$ type or near $\alpha+\beta$ type, and also there can be provided titanium alloy which is excellent in workability as well as specific strength and resistance to corrosion, and the method of processing the titanium alloy.

The embodiments of the present invention are merely examples to which the present invention is applied, and various modifications may be made without departing from the subject matter of the present invention. For example, titanium alloy of $\alpha+\beta$ type or near $\alpha+\beta$ type may be used as titanium alloy. Furthermore, the temperature conditions of the tensile test are merely examples, and they do not limit the present invention.

Next, the first and second embodiments and the first and second comparative examples described above will be described in detail, but it is needless to say that the present invention is not limited by these embodiments.

First Embodiment: Hydrogen Treatment of Titanium Alloy

In the first embodiment, a test piece (rectangular parallelepiped of 12.5 mm×25 mm×50 mm) of Ti-6Al-6V-2Sn alloy corresponding to $\alpha+\beta$ type titanium alloy was subjected to the treatment containing (1) hydrogen storing (adsorbing) step, (2) solution-treatment step, (3) hot rolling step and (4) dehydrogenating step.

(1) Hydrogen Storing (Adsorbing) Step

The test piece of titanium alloy was heated from the room temperature under argon gas atmosphere (or argon gas stream) (pressure: 0.005 MPa). After the temperature reached 1073K, the argon gas atmosphere (or stream) was switched to hydrogen gas atmosphere (or stream) (0.005 MPa), and the test piece was kept for five minutes under the hydrogen gas atmosphere (or stream). Thereafter, the hydrogen gas atmosphere (or stream) was switched to the argon gas atmosphere (or stream) (pressure: 0.005 MPa) again, and the test piece was cooled to the room temperature. As a result, hydrogen-stored (adsorbed) titanium alloy in which hydrogen of 0.3 wt % of the test piece was stored (adsorbed) was obtained.

(2) Solution-Treatment Step

The test piece of the hydrogen-stored titanium alloy obtained in the hydrogen storing step (1) was heated to 1273K (1000° C.) in the air atmosphere and kept a that temperature for 30 minutes. Thereafter, the test piece was cooled to the room temperature by water cooling.

(3) Hot-Rolling Step

After the solution-treatment step (2), the test piece was subjected to hot rolling with a draft (rolling reduction) of 80% at temperature of 923K (650° C.) in the air atmosphere. After the hot rolling, the test piece was left cooled to the room temperature.

(4) Dehydrogenating Step

The test piece processed in the hot rolling step was heated in a vacuum, and kept at 873K (600° C.) for 2 hours. Thereafter, the heating was stopped, and the test piece was left cooled in a furnace.

Second Embodiment: Hydrogen Treatment of Titanium Alloy

In the second embodiment, a test piece of Ti-4.5Al-3V-2Mo-2Fe alloy (having the same shape and size as the first embodiment) corresponding to α+β type titanium alloy was subjected to the same treatment as the first embodiment.

First Comparative Example: Hot Rolling of Titanium Alloy

A test piece of Ti-6Al-6V-2Sn alloy (having the same shape and size as the first embodiment) corresponding to α+β type titanium alloy was merely subjected to hot rolling with a draft (rolling reduction) of 80% at temperature of 923K (650° C.) in the air atmosphere. After the hot rolling, the test piece is left cooled.

Second Comparative Example: Hot Rolling of Titanium Alloy

A test piece of Ti-4.5Al-3V-2Mo-2Fe alloy (having the same shape and size as the first embodiment) corresponding to α+β type titanium alloy was subjected to the same treatment as the first comparative example.

Tensile (Tension) Test

Plate-like test pieces (2 mm in plate thickness, 5 mm in width, 4 mm in gauge length) for tensile test were created from the test pieces of titanium alloy obtained according to the first and second embodiments and the first and second comparative examples, mounted in a tensile test machine and tested while put in vacuum ($10^{-6}$ Torr). The gauge length after the test was measured, and an extension (elongation) (%) was calculated on the basis of the gauge length (4 mm) before the test. Deforming stress [MPa] was calculated from the tensile load [N] and the initial cross-sectional area (20=$^2$) under plastic deformation. Furthermore, a stress-strain curve was created and the rate sensitivity index (m value) was calculated on the basis of the test result.

The tensile test was conducted on each of the above test pieces according to the above test procedure while the temperature condition was set to each of the six temperature conditions of 873K (600° C.), 923K (650° C.), 973K (700° C.), 1023K (750° C.), 1073K (800° C.) and 1123K (850° C.). The initial strain rate was set to the following five conditions of $0.001s^{-1}$, $0.005s^{-1}$, $0.01s^{-1}$, $0.05s^{-1}$ and $0.1s^{-1}$.

Test result is shown in the table 1 of FIG. 15A. Furthermore, the stress-strain curves (diagram) are shown in FIGS. 3 and 4, the correlation between the initial strain rate and the extension and the correlation between the initial strain rate and the deforming stress are shown in connection with the temperature variation in FIGS. 7 to 12. The correlation between the temperature and the extension is shown in FIG. 13, and the correlation between the temperature and the deforming stress is shown in FIG. 14.

What is claimed is:

1. A α+β titanium alloy of Ti-6Al-6V-2Sn that is formed by subjecting titanium alloy to a treatment containing a hydrogen storing step for making the titanium alloy store hydrogen therein, a solution-treatment step for heating the titanium alloy having the hydrogen stored therein in the hydrogen storing step to apply a solution treatment to the hydrogen-stored titanium alloy, a cooling step for cooling the heated hydrogen-stored titanium alloy to develop martensitic transformation in the hydrogen-stored titanium alloy, a hot rolling step for heating the martensitic-transformed titanium alloy to a temperature range from not less than 773K to not more than 923K and hot-rolling the martensitic-transformed titanium, a dehydrogenation step for dehydrogenating the hot-rolled titanium alloy, and a superplastic forming step for deforming the titanium alloy at an initial strain rate of not less than $0.001s^{-1}$ to not more than $0.05s^{-1}$ in a temperature range from not less than 923K to not more than 1073K;

wherein hydrogen storing step comprises a step of heating the titanium alloy under inert gas stream, a step of switching the inert gas stream to hydrogen gas stream after the temperature reaches a processing temperature which is set in a temperature range from not less than 823K to not more than 1223K, a step of elapsing a predetermined time under the hydrogen gas stream in the temperature range, a step of switching the hydrogen gas stream to the inert gas stream, and a step of cooling the titanium alloy, and the titanium alloy has a property to obtain an extension of 4000% or more at an initial strain rate of $0.01s^{-1}$ in a temperature range from not less than 923K to not more than 1073K and a property to obtain an extension of 4000% or more at an initial strain rate of not less than $0.005s^{-1}$ to not more than $0.01s^{-1}$ in a temperature of 1073K and further has a property to obtain an extension of about 2000% at an initial strain rate of $0.1s^{-1}$ in a temperature range from not less than 923K to not more than 1073K and a property to obtain an extension of 2000% or more at an initial strain rate of more than $0.01s^{-1}$ to not more than $0.1s^{-1}$ in a temperature of 1073K.

2. The titanium alloy according to claim 1, wherein the average particle diameter of the crystal grains of the titanium alloy after the dehydrogenation step is equal to 3.0 μm or less.

3. The titanium alloy according to claim 1, wherein the solution-treatment step contains a step of heating the titanium alloy at a temperature equal to β-transformation point or more in the air and keeping the titanium alloy at the temperature equal to the β-transformation point or more for a predetermined time or more.

4. The titanium alloy according to claim 1, wherein the hot rolling step contains a step of heating the titanium alloy at a temperature of not more than β-transformation point and not less than 773K and hot-rolling the titanium alloy to pulverize martensite of the titanium alloy, form high-density transfer region in the titanium alloy and deposit hydride.

5. The titanium alloy according to claim 1, wherein the dehydrogenation step contains a step of removing an oxide film on the surface of the titanium alloy which has been treated in the hot rolling step, and a step of heating the oxide-film-removed titanium alloy to at least a processing temperature or more in vacuum, wherein the processing temperature is set at least in a temperature range from not less than 823K to not more than 973K and keeping the oxide-film-removed titanium alloy for a predetermined time at the processing temperature or more.

6. The titanium alloy according to claim 1, wherein the titanium alloy is deformed at an initial strain rate of not less than $0.005s^{-1}$ to not more than $0.05s^{-1}$.

7. The titanium alloy according to claim 1, wherein the titanium alloy is deformed at an initial strain rate of not less than $0.01s^{-1}$ to not more than $0.05s^{-1}$.

8. The titanium alloy according to claim 1, wherein the maximum particle diameter of the crystal grains of the titanium alloy after the dehydrogenation step is not more than 3.0 μm.

9. The titanium alloy according to claim 1, wherein the average particle diameter of the crystal grains of the titanium alloy after the dehydrogenation step is not more than 1.0 μm.

10. A method of manufacturing high-strength titanium alloy comprising:

a hydrogen storing step for making α+β titanium alloy of Ti-6Al-6V-2Sn store hydrogen therein;

a solution-treatment step for heating the titanium alloy in which hydrogen is stored in the hydrogen storage step, thereby applying solution-treatment to the hydrogen-stored titanium alloy;

a cooling step for cooling the heated hydrogen-stored titanium alloy to develop martensitic transformation in the hydrogen-stored titanium alloy;

a hot rolling step for heating the martensitic-transformed titanium alloy to a temperature range from not less than 773K to not more than 923K and hot-rolling the martensitic-transformed titanium; and a dehydrogenation step for dehydrogenating the hot-rolled titanium alloy, and a superplastic forming step for deforming the titanium alloy at an initial strain rate of not less than $0.001s^{-1}$ to not more than $0.05s^{-1}$ in a temperature range from not less than 923K to not more than 1073K, wherein the hydrogen storing step comprises:

a step of heating the titanium alloy under an inert gas atmosphere;

a step of switching the inert gas atmosphere to a hydrogen gas atmosphere after the temperature reaches a processing temperature set in a temperature range from not less than 823K to not more than 1223K;

a step of elapsing a predetermined time under the hydrogen gas atmosphere;

a step of switching the hydrogen gas atmosphere to the inert gas atmosphere; and a step of cooling the titanium alloy to obtain the titanium alloy having a property to obtain an extension of 4000% or more at an initial strain rate of $0.01s^{-1}$ in a temperature range from not less than 923K to not more than 1073K and a property to obtain an extension of 4000% or more at an initial strain rate of not less than $0.005s^{-1}$ to not more than $0.01s^{-1}$ in a temperature of 1073K and further having a property to obtain an extension of about 2000% at an initial strain rate of $0.1s^{-1}$ in a temperature range from not less than 923K to not more than 1073K and a property to obtain an extension of 2000% or more at an initial strain rate of more than $0.01s^{-1}$ to not more than $0.1s^{-1}$ in a temperature of 1073K.

11. The method of manufacturing the high-strength titanium alloy according to claim 10, wherein the average particle diameter of the crystal grains thereof after the dehydrogenation step is equal to 3.0 μm or less.

12. The method of manufacturing the high-strength titanium alloy according to claim 10, wherein the solution-treatment step contains a step of heating the titanium alloy at a temperature equal to β-transformation point or more in the air and keeping the titanium alloy at the temperature equal to the β-transformation point or more for a predetermined time or more.

13. The method of manufacturing the high-strength titanium alloy according to claim 10, wherein the hot rolling step contains a step of heating the titanium alloy at a temperature of not more than β-transformation point and not less than 773K and hot-rolling the titanium alloy to pulverize martensite of the titanium alloy, form high-density transfer region in the titanium alloy and deposit hydride.

14. The method of manufacturing the high-strength titanium alloy according to claim 10, wherein the dehydrogenation step contains a step of removing an oxide film on the surface of the titanium alloy treated in the hot rolling step, and a step of heating the oxide-film-removed titanium alloy to at least a processing temperature or more in vacuum, wherein the processing temperature is set at least in a temperature range from not less than 823K to not more than 973K and keeping the oxide-film-removed titanium alloy for a predetermined time at the processing temperature or more.

15. The method of manufacturing the high-strength titanium alloy according to claim 10, wherein the maximum particle diameter of the crystal grains of the titanium alloy after the dehydrogenation step is not more than 3.0 μm.

16. The method of manufacturing the high-strength titanium alloy according to claim 10, wherein the average particle diameter of the crystal grains of the titanium alloy after the dehydrogenation step is not more than 1.0 μm.

* * * * *